US005563850A

United States Patent [19]

Hanapole

[11] Patent Number: 5,563,850

[45] Date of Patent: Oct. 8, 1996

[54] FOOD INTAKE TIMER

[76] Inventor: Philip L. Hanapole, 30 Mahores Dr., Wayside, N.J. 07712

[21] Appl. No.: 456,671

[22] Filed: Jun. 1, 1995

[51] Int. Cl.[6] ..... G04F 8/00

[52] U.S. Cl. ..... 368/89; 368/107; 368/108

[58] Field of Search ..... 368/89, 111–113, 368/245, 244, 251, 10

[56] References Cited

U.S. PATENT DOCUMENTS 4,387,437 6/1983 Lowrey et al. ..... 368/113

4,396,904 8/1983 Hanaoka ..... 368/89

*Primary Examiner*—Bernard Roskoski

*Attorney, Agent, or Firm*—Charles F. Gunderson

[57] ABSTRACT

A device for mounting on the wrist of an individual. The device includes a motion-sensing element that is coupled to and starts a timing unit when the wrist is moved—as in raising an utensil of food to the mouth. The timing unit is coupled to a signal generator that it actuates after a given interval of time. The signal generator actuates an annunciator unit, in contact with the wrist of the individual, that produces a tangible sensation on the wrist of the individual to advise the individual that it is time for more food, and that the cycle can be repeated. The tangible sensation may be a physical prodding or and electrical stimulus, but it must not be apparent to anyone but the individual. The given interval may be adjusted to the needs of the individual.

5 Claims, 1 Drawing Sheet

FOOD INTAKE TIMER

BACKGROUND OF THE INVENTION

There are very many methods or schemes for losing weight. The obvious ones are, of course, to cut down on the food on ones plate; to carefully measure the amount of food served; to choose food of minimum calories; and to keep the caloric content at a prescribed amount for a given individual. This plus exercise—again of a minimum prescribed amount—should result in slow, but steady, weight loss.

However, these techniques are not always convenient—or even quite possible—in the modern world of business lunches, and social functions. One can hardly tell the chef, or the hostess, how many ounces of which foods are within current diet.

One could try to guess the permissable amounts of food, and eat only those portions. However, for an admittedly-heavy eater with a correspondingly good appetite, that small portion would be finished in no time, and the hungry eater would be left looking at the tantalizing morsels on his plate until the other, slower-eating guests are finished, and the plates can be taken up before the next course is served. As a point of etiquette, the plates cannot be picked up until all the guests are finished.

This invokes another of the schemes that may help. The eater, after taking a forkful of food, can count to a given number before taking another mouthful. This is a considerable help to slow down the mechanics of eating—and, incidentally, improve the mastication and digestion of the food—but it requires concentration and would seriously impede dinner conversation. Nevertheless this subtle delay tactic could help getting through a long dinner.

The object of this invention is to provide a means for an individual, on taking a fork of food, for example, being alerted to a given period of time for delaying the taking another forkful of food; without any visible or audible signal, or any counting or other mental effort on his part.

A further object of this invention is to provide an unobtrusive device that can be worn on a wrist during dinner to be actuated by a motion of the wrist in the process of feeding, and that can, after a given interval of time, signal, automatically, a desired interval between mouthfuls.

SUMMARY OF THE INVENTION

A device is provided, that can be worn on the wrist of the right or left arm of a person, that can be actuated by a motion of the arm—specifically raising the arm with a fork full of food—to actuate a timer that, after a given interval, in turn, actuates a device that alerts the wearer to a given passage of time and, if the wearer wants to, or needs to, modulate food input, that another mouthful of food may be considered.

This can be done by a device that can be combined with, or a part of, a wrist watch. It must be worn on the wrist of the arm with which the person carries food from the plate to his mouth, and have a motion sensitive element that responds to the lifting of the arm. When the arm is raised this element triggers a timer that can be set for a given interval, and that, after the given interval, actuates a device that alerts the wearer to the passage of time, and that another, timely, mouthful of food is in order.

The motion sensitive element, or detector, can be of any type. It will, mechanically, close a switch that will turn on a timer. The timer can also be of any of the available types, preferably electronic, and adjustable over any desired range.

Actually, once the timer is actuated, it continues until its cycle is complete.

The timer, in turn actuates a device that can produce a signal that can be felt by the wearer. This can be mechanical, in the form of a buzzer, that can be felt by the wearer. However, in a social context, an audible signal would hardly be desirable, at short intervals during a dinner. The signal should be discernable only by the wearer. This would suggest a very low frequency vibrator, or any tangible motion on the surface of the wrist.

Another indicator that could not be heard by anyone would be an electrical stimulant. This could be provided between two electrodes positioned on the back of the device, in contact with the wrist. Suitable circuitry can be provided to generate a voltage just high enough to be perceptible but of infinitesimaly low amperage to be of no conceivable danger to the wearer.

In effect, the wearer turns on the device, and when his arm raises, presumably with an utensil, from plate to mouth, the wrist motion detector switch closes, and the timer device is triggered. The timer counts for a prescribed interval—usually a minute or less—which can be adjusted to suit the individual, and then triggers the annunciator, or stimulator, that is in contact with the wrist. This makes the individual aware that it is time for another mouthful.

DETAILED DESCRIPTION OF THE DRAWINGS

Figure 1:
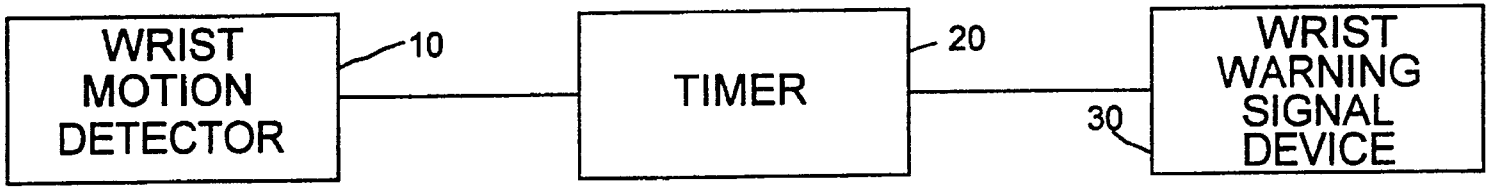
FIG. 1 shows a block diagram of the essential elements of this invention.

FIG. 1 shows a wrist motion dectector 10 connected to a timer 20 that, in turn, is connected to a wrist-warning signal device.

The wrist motion detector can be of any, presumably, mechanical inertia device that can close or actuate a switch that can trigger a timer.

The timer can be of any well known type from a mechanical escapement mechanism to any of the very-popular electronic pulse timers. This can be preset for a given interval of time, but this interval of time can be adjustable to suit the individual and the occasion.

The wrist warning signal device, or annunciator, can be of any means for providing an impulse or stimulus to the surface of the wrist that the wearer can detect and be aware of. This could be of some mechanical motion or pressure, of almost any type, that can be provided by a mechanical or electro-mechanical device. It could also be provided by a mild electrical shock between two electrodes in contact with the skin of the wrist.

Figure 2:
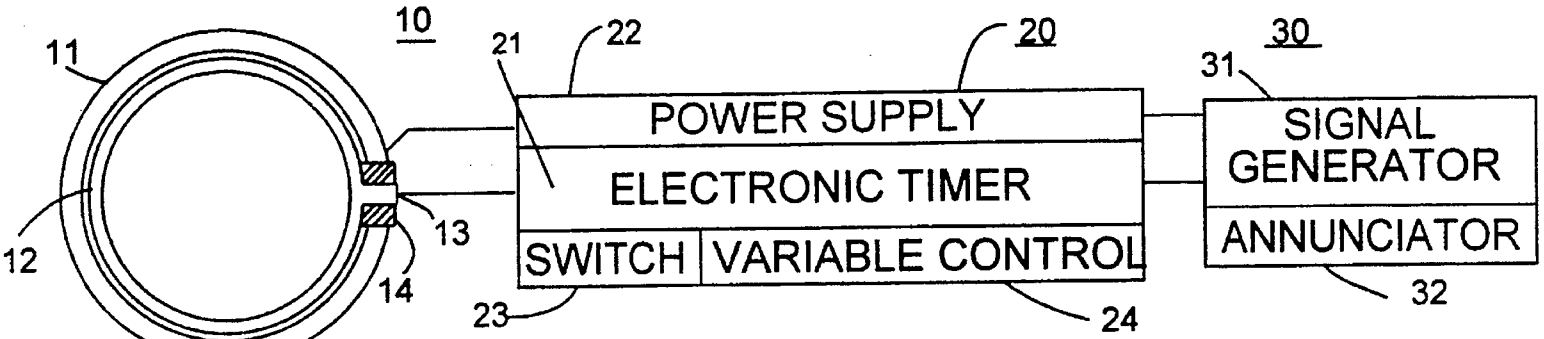
FIG. 2 shows the same elements in more detail.

FIG. 2 shows the elements of FIG. 1 in somewhat more detail. A wrist motion detector 10 has an outer metal ring 11 which may be attached to part of the device that is mounted on the wrist. An inner, metal ring 12 is positioned very close to the outer ring, and has a metal projection 13 that secures the inner ring, which is thereby held in this position by a flexible rubber, or plastic, gasket 14 that also serves as an insulator between the inner and outer metal elements.

Since the inner metallic ring 12 is flexibly held by the gasket 14, it can be displaced by any mechanical motion to touch the outer ring 11 to act as an electrical switch. The inner metallic ring 12 should have enough mass, and inertia, and be held loosely enough by the gasket 14, to make contact with the outer metallic ring 11—which is secured to the mounting that is moved with the wrist—when the wrist is moved, even slightly.

The timer 20, as shown here, includes an electronic timer 21 with a power supply 22. The electronic timer is connected to and switched on by the elements 11 and 12 of the motion detector. A switch 23 should, logically, be provided to turn on and off the device when and as needed. A variable control 24 should be provided to control the length of time between the initial electrical contact and the warning signal to the wrist.

The wrist warning signal device 30 shown here has a signal generator 31 and an annunciator 32 for applying some sort of signal to the wrist of the wearer. The signal generator 31 is coupled to and actuated by the electronic timer 21. The power supply 22 may also supply power to the signal generator that actuates whatever device will be used to apply a signal to the wrist of the wearer.

Figure 3:
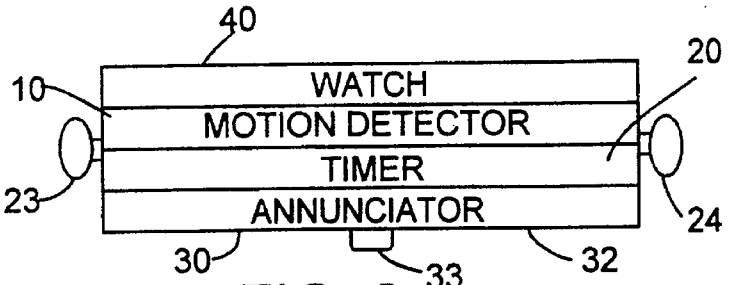
FIG. 3 shows a side view of a typical embodiment of the device.

FIG. 3 is a side view of a typical embodiment of the invention, which may be attached to—or even a part of—a wrist watch. The outer layer 40 would be the watch itself, or its face. An under layer could be a motion detector 10, attached to, or part of, an electronic timer 20, which, in turn, actuates a wrist warning signaler or annunciator 30. The on—off switch 23 is a part of the electronic timer 20; as is the variable control 24 to adjust the length of the time interval.

The wrist warning signaler or annunciator 32 may have a mechanical projection 33 that can be set into some kind of motion against the wrist of the wearer that can be quietly detected. All of these elements are necessary, but many, or all of them could be compacted into one unit, not much larger than a common watch.

Figure 4:
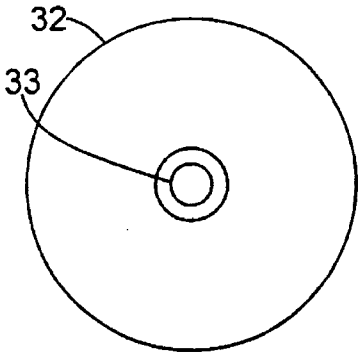
FIG. 4 shows a bottom view of a typical mechanical annunciator.

FIG. 4 shows a bottom view of a typical mechanical annunciator 32 with its mechanical projection 33, free to move with respect to the body of the annunciator 32 or a wrist watch, against the wrist of the wearer. This mechanical projection can be of any size and shape, and flat or rounded. The mechanical notion can be a single prod, or a series of prods, enough to be clearly detectable, against the wrist of the wearer.

Actually, while a centrally-located projection is shown, it is obvious that the projection could be located anywhere that would facilitate its mechanical function. More than one unit may also be desirable. While a flat of rounded projection is shown here, a smaller, sharper projection might be more effective with less mass and lower power requirements, and even more tangible inpact against the skin, which may be very significant in practice This motion can be provided mechanically or electromechanically by very many well-known means that are all applicable to this device. Actually, the electromechanical system would be easier and simpler to actuate, but the potential battery drain would be critical, since reducing the size of the device would limit battery size and capacity.

A mechanically actuated device is entirely logical, and can be provided by many means. This would probably require a spring or the like and means for winding it before use, and whenever necessary.

Figure 5:
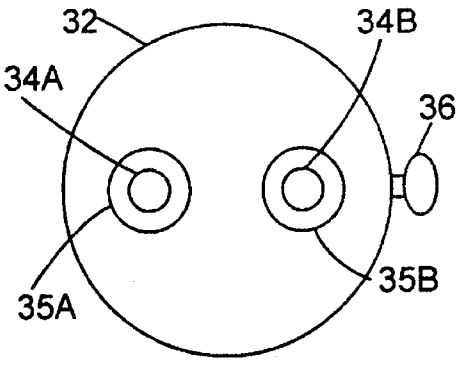
FIG. 5 shows a bottom view of a typical electrical annunciator.

FIG. 5 shows a bottom view of another type of annunciator 32. This has electrodes 34A and 34B projecting slightly from the case of the annunciator 32, and electrically insulated from the case, which may be metallic, by insulators 35A and 35B. The electrodes, in contact with the skin of the wearer, will produce a current through the surface of the skin when any voltage is applied to the terminals.

At very low voltages, under, say, 50 volts, this current would be undetectible, particularly with relatively dry skin. However, with higher voltages, and particularly with pulsating or alternating circuitry, the skin very definitely feels the slight tingling or shock of the voltage, even at microscopic, arid quite harmless amperage.

The level of the voltage can, of course, be adjustable, and can be set to a level that is just perceptible for a given individual, but in no way dangerous. Actually, the current available from a watch battery is in microamps, which could not, possibly be harmful. Also, the current is across the surface of the skin, and could not, possibly, reach any sensitive body organs. Lastly, the distance between electrodes can be reduced to a minimum to minimize subcutaneous current.

The voltage can be amplified by any of the techniques well known in the art to produce pulses or bursts of alternating current at a voltage that can be felt by the wearer.

Since this is intended to be a very discrete means for providing a person with a measured spacing of time between feeding intervals, presumably at dinner and among guests, the problem is to have an annunciator or stimulator that is tangible to the wearer, but unobtrusive to anyone at the table. An audible buzzer would not do; nor would any other visible signal.

The basic elements to provide this function can be the simple elements defined here that can be mounted in a flat circular package and attached to the back of a watch for simplicity and camouflage. Most of the elements are well known, and are available in many forms, as noted earlier, to those skilled in the separate art forms.

However, it is also obvious that the entire combination could, by the various state of the art techniques, be compacted to fit within a relatively-small watch.

The wrist motion detector could be analogous to one of the self-winding mechanisms of recent mechanical wrist watches, with its function altered to also actuate a timer as well as winding the wrist watch. The timer could also be mechanical as in innumerable old sports timers, and actuated mechanically. A mechanical annunciator could be very slowly wound up during the time interval, to be released suddenly at the end of the interval.

However, it is more likely that it would be an electronic, or quartz timer similar to the very popular present day timers, but with adjustable, preset time intervals to control the signaller or annunciator to a given interval.

As noted earlier, the annunciator, to be inaudible, may require much more power than a modern quartz watch or timer. However, an external power supply of any size can easily be concealed within, and wired through the sleeve of a dinner jacket, to be connected to the device to eliminate drain on the watch battery.

What is claimed is:

1. A wrist-mounted device for measuring an interval of time automatically comprising; a motion detecting device comprising ring means for detecting a movement of a wrist, as in moving an utensil carrying food from a plate to a mouth; means for mounting said motion detecting device on said wrist; an electronic timer, actuated by said motion-detecting device, to start a time interval from said movement of said wrist; means for terminating said electronic timer at the end of said time interval; a signal generator actuated at the termination of said electronic timer; and an annunctator in contact with said wrist, coupled to and actuated by said signal generator at the end of said time interval, to apply a tangible signal to said wrist, to indicate to a dieter, who is seeking to pace his food intake, that he may take another mouthful of food, at which event said motion detecting device is again actuated to re-actuate said electronic timer and re-apply said tangible signal to said wrist.

2. A wrist-mounted device, as in claim 1, wherein said ring means comprises; a first, outer metal ring element rigidly attached to said wrist-mounted device; a second, inner metal ring element, mounted inside adjacent to and loosely coupled to said first element to make contact with said first element when said wrist is moved; and electrical connections between said first and second elements and said electronic timer to actuate said timer when contact is made between said first and second metal ring elements, when said wrist is moved.

3. A wrist-mounted device, as in claim 1, wherein said annunciator comprises; a first portion in contact with said wrist; a second portion, also in contact with said wrist, movable with respect to said said first portion; said signal generator providing means for moving said first portion with respect to said second portion to apply said tangible signal to said wrist.

4. A wrist-mounted device, as in claim 1, wherein said annunciator comprises; a first electrode in contact with the surface of said wrist; a second electrode, spaced from said first electrode, also in contact with said surface of said wrist; means, associated with said signal generator, for applying a voltage between said first and second electrodes high enough to provide a tangible signal to apply to said wrist.

5. A wrist mounted device, as in claim 1, having means for controlling said electronic timer to vary the length of said time interval.

* * * * *